US009616696B2

(12) United States Patent
Di Risio et al.

(10) Patent No.: US 9,616,696 B2
(45) Date of Patent: Apr. 11, 2017

(54) COATING FOR PAPER ADAPTED FOR INKJET PRINTING

(71) Applicant: EcoSynthetix Inc., Burlington (CA)

(72) Inventors: Sabina Di Risio, Burlington (CA); Ralph De Jong, Burlington (CA); Ray Carlson, Burlington (CA)

(73) Assignee: EcoSynthetix Inc., Burlington (CA)

( * ) Notice: Subject to any disclaimer, the term of this patent is extended or adjusted under 35 U.S.C. 154(b) by 0 days.

(21) Appl. No.: 14/521,404

(22) Filed: Oct. 22, 2014

(65) Prior Publication Data

US 2015/0110977 A1 Apr. 23, 2015

Related U.S. Application Data

(60) Provisional application No. 61/894,528, filed on Oct. 23, 2013, provisional application No. 62/053,993, filed on Sep. 23, 2014.

(51) Int. Cl.
*B41M 5/52* (2006.01)

(52) U.S. Cl.
CPC ..... *B41M 5/5245* (2013.01); *B41M 5/5218* (2013.01); *B41M 5/5236* (2013.01)

(58) Field of Classification Search
CPC ..... B41M 5/5245
USPC ..... 523/160, 161
See application file for complete search history.

(56) References Cited

U.S. PATENT DOCUMENTS 4,554,021 A * 11/1985 Harvey ..... C08B 31/125 106/214.1
4,683,285 A * 7/1987 Paar ..... C08G 18/6407 204/501
5,302,437 A * 4/1994 Idei ..... B41M 5/504 347/105
5,886,085 A * 3/1999 Heuwinkel ..... C08G 18/0809 524/507
6,281,267 B2 8/2001 Parazak
6,455,134 B1 9/2002 Rabasco
6,530,656 B1 3/2003 Teraoka et al.
6,536,891 B2 3/2003 Oyanagi
6,551,695 B2 4/2003 Kaneko et al.
6,644,377 B1 11/2003 Lewis
6,656,545 B1 12/2003 Schliesman et al.
6,677,386 B1 * 1/2004 Giezen ..... C08B 30/12 106/206.1
6,713,550 B2 3/2004 Schliesman et al.
6,743,480 B1 6/2004 Almog et al.
6,755,915 B1 6/2004 Van Soest et al.
6,777,462 B2 8/2004 Smith et al.
6,805,929 B2 10/2004 Koga et al.
6,825,252 B2 11/2004 Helbling et al.
6,979,365 B2 12/2005 Tsuru et al.
7,045,002 B2 5/2006 Bauer et al.
7,141,638 B2 11/2006 Jikihara et al.
7,160,420 B2 1/2007 Helbling et al.
7,172,651 B2 2/2007 Chen et al.
7,285,586 B2 10/2007 Helbling et al.
7,553,395 B2 6/2009 Stoffel et al.
7,803,224 B2 9/2010 Schliesman et al.
7,897,251 B2 3/2011 Courtenay et al.
8,092,873 B2 1/2012 Wang et al.
8,123,907 B2 2/2012 Stoffel et al.
8,256,887 B2 9/2012 Zhou et al.
8,425,728 B2 4/2013 Zhou et al.
8,449,665 B2 5/2013 Pal et al.
8,709,555 B2 4/2014 Pal et al.
8,727,528 B2 5/2014 Romano, Jr.
8,821,998 B2 9/2014 Romano
2003/0041988 A1 * 3/2003 Vihervaara ..... D21H 17/29 162/149
2004/0001844 A1 1/2004 Holgersson
2004/0204535 A1 * 10/2004 Confalone ..... B41M 5/5245 524/543
2005/0061203 A1 3/2005 Helbling et al.
2005/0174414 A1 * 8/2005 Yoshida ..... B41M 5/508 347/105
2006/0042768 A1 * 3/2006 Brown ..... D21H 19/42 162/135
2006/0100338 A1 * 5/2006 Andersson ..... C08K 3/24 524/442
2007/0087138 A1 4/2007 Koenig et al.
(Continued)

FOREIGN PATENT DOCUMENTS

CA 1248267 A1 1/1989
CA 2207714 A1 12/1995
(Continued)

OTHER PUBLICATIONS

Yukihiro, S. English language abstract of JPH0633397 A, published Feb. 8, 1994.
Sekisui Specialty Chemicals, Selvol Polyvinly Alcohol for Ink Jet Printing Papers, 2001.
Song et al., "Starch nanoparticle formation via reactive extrusion and related mechanism study", Carbohydrate Polymers vol. 85 (2011) pp. 208-214. Atlanta, GA. USA.
Fink, Johannes Karl, Handbook of Engineering and Speciality Thermoplastics: vol. 2 Water Soluble Polymers, pp. 39-68, 2011.
Lundberg, A. "Ink-Paper Interactions and Effect of Print Quality in Inkjet Printing" (2011) Printed by Kopieringen Mid Sweden University, Sundsvall, Sweden.
(Continued)

*Primary Examiner* — Doris Lee

(57) ABSTRACT

This specification describes a composition for coating on a substrate, such as paper, useful for inkjet printing with ink having an anionic dye. The coating comprises a cationic binder and preferably pigment. The binder may be made of latex forming cationic biopolymer particles, for example made from cationic starch. Cationic biopolymer polymers are used as a cationic fixative. Optionally, a salt with a polyvalent metal ion may be added top the composition. With this addition, the substrate is also suitable for printing with dispersed pigment based inkjet ink.

16 Claims, 6 Drawing Sheets

(56) References Cited

U.S. PATENT DOCUMENTS

| | | | | |
|---|---|---|---|---|
| 2010/0300633 | A1* | 12/2010 | Goto | D21F 9/003 162/164.6 |
| 2011/0042841 | A1 | 2/2011 | Wildi et al. | |
| 2011/0050827 | A1 | 3/2011 | Romano, Jr. et al. | |
| 2012/0154502 | A1* | 6/2012 | Romano, Jr. | B41M 5/52 347/105 |
| 2012/0263894 | A1 | 10/2012 | Bloembergen | |
| 2013/0062807 | A1 | 3/2013 | Wildi et al. | |
| 2013/0089683 | A1 | 4/2013 | Cormier et al. | |

FOREIGN PATENT DOCUMENTS

| | | | |
|---|---|---|---|
| CA | 2320745 | A1 | 7/2000 |
| CA | 2419949 | A1 | 1/2002 |
| CA | 2396980 | A1 | 5/2002 |
| CA | 2819511 | A1 | 6/2012 |
| CA | 2825968 | A1 | 8/2012 |
| CA | 2868520 | A1 | 10/2013 |
| EP | 2391771 | A1 | 12/2011 |
| EP | 2289705 | A2 | 3/2013 |
| GB | 1420392 | | 6/1973 |
| JP | 0633397 | A | 2/1994 |
| JP | 2007119990 | A | 5/2007 |
| WO | 0208516 | A1 | 1/2002 |
| WO | 0208517 | A1 | 1/2002 |
| WO | 2009157952 | A1 | 12/2009 |
| WO | 2010065750 | A1 | 6/2010 |
| WO | 2010084088 | A2 | 7/2010 |
| WO | 2011071742 | A2 | 6/2011 |
| WO | 2011084697 | A2 | 7/2011 |
| WO | 2011155979 | A2 | 12/2011 |
| WO | 2012057732 | A1 | 5/2012 |
| WO | 2012062967 | A1 | 5/2012 |
| WO | 2012162845 | A1 | 12/2012 |

OTHER PUBLICATIONS

Londo, Mike, Alternate to silica pigments for inkjet paper coating provides improved runability and produces high quality needed for color printer demands, http://www.risiinfo.com/db_area/archive/p_p_mag/2000/0005/focus1.htm, May 2000.

Filenkova, A. "Distribution of Ink-Jet Ink Components Via TOF-SIMS and Optical Image Analysis". (2009), A thesis, for the degree of Masters of Applied Science, Dept. of Chemical Engineering and Applied Chemistry. University of Toronto.

Lamminmaki, et al., "The Role of Binder Type in Determining Inkjet Print Quality", (2010) Nordic Pulp & Paper Research Journal. pp. 380-390, vol. 25 No. Mar. 2010. Sweden.

Alkaline Paper Advocate, Paper Definitions, vol. 1, No. 5, http://cool.conservation-us.org/byorg/abbey/ap/ap06/ap06-5/ap06-503.html, Nov. 1993.

Hamilton, John, What Is HP's ColorPRO Technology Strategy?, InfoTrends InfoBlog, http://blog.infotrends.com/?s=What+Is+HP%E2%80%99s+ColorPRO+Technology+Strategy, Apr. 17, 2010.

Janardhnan, S. "Styrene maleic anhydride imide-resin (SMAI): A novel cationic additive in paper coating for ink jet printing". (2005) 98 pages, University of Toronto.

* cited by examiner

SAMPLE A

SAMPLE B

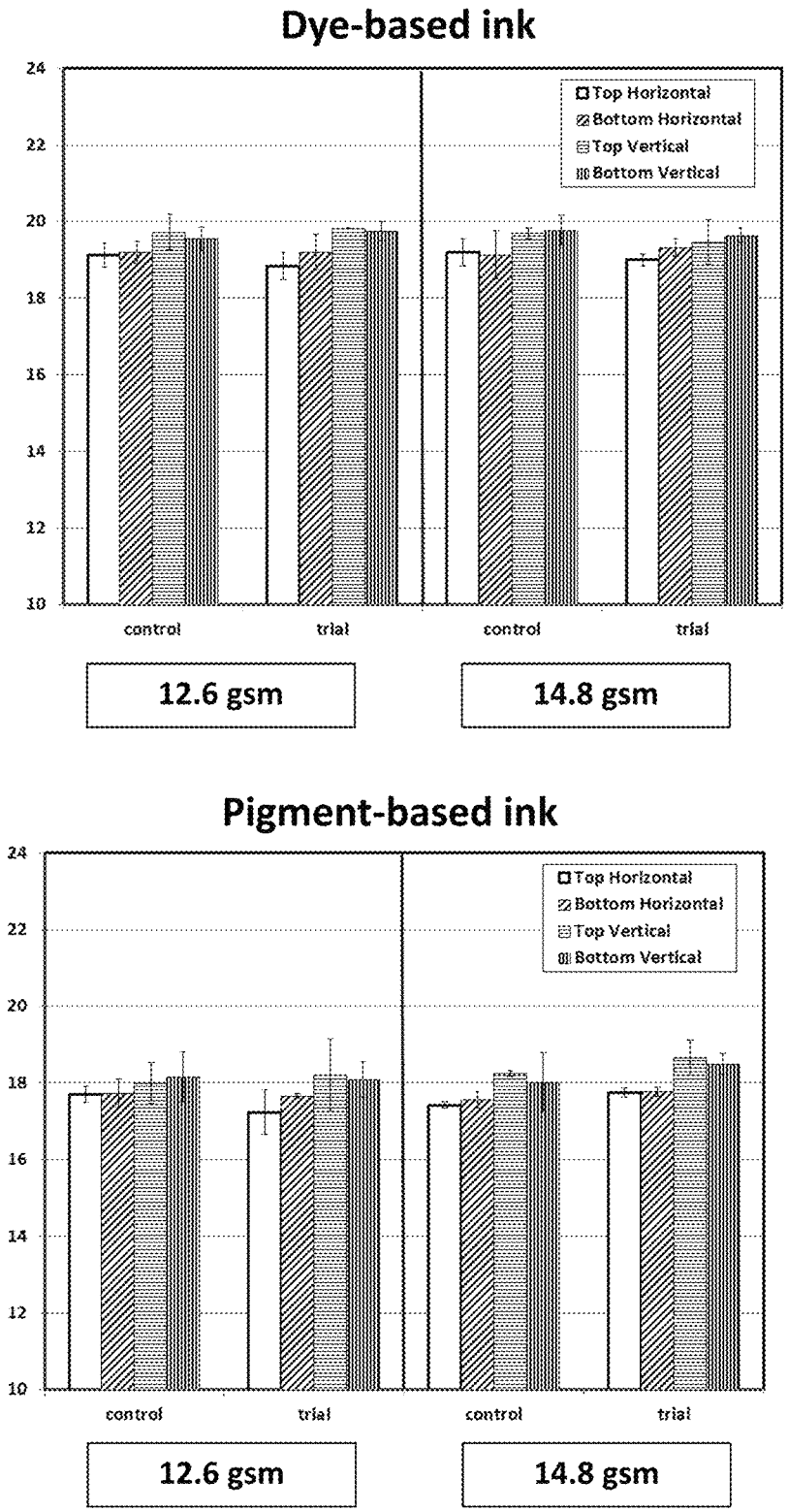
FIGURE 4 - Feathering

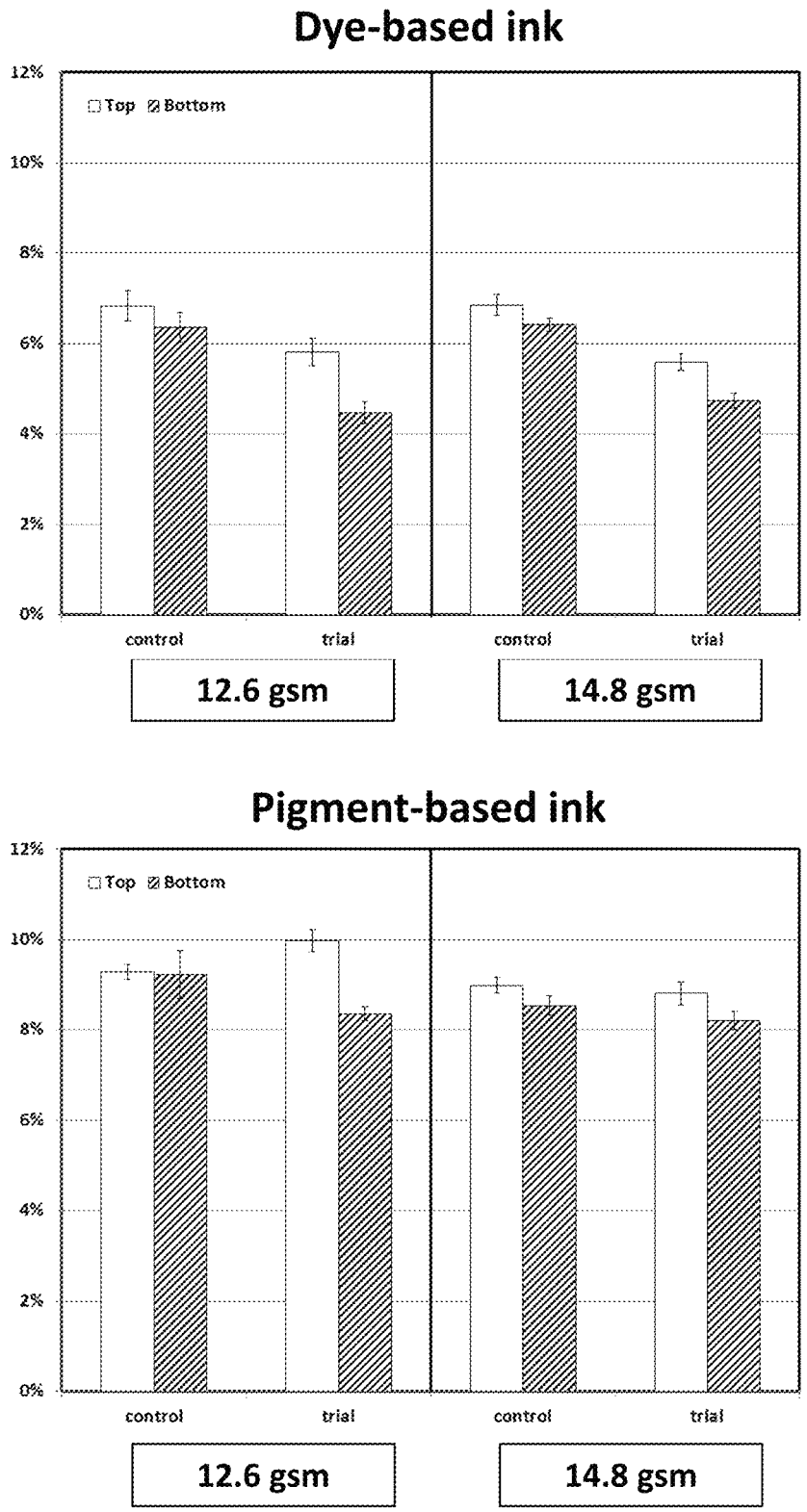
FIGURE 5 - Mottle solid green area

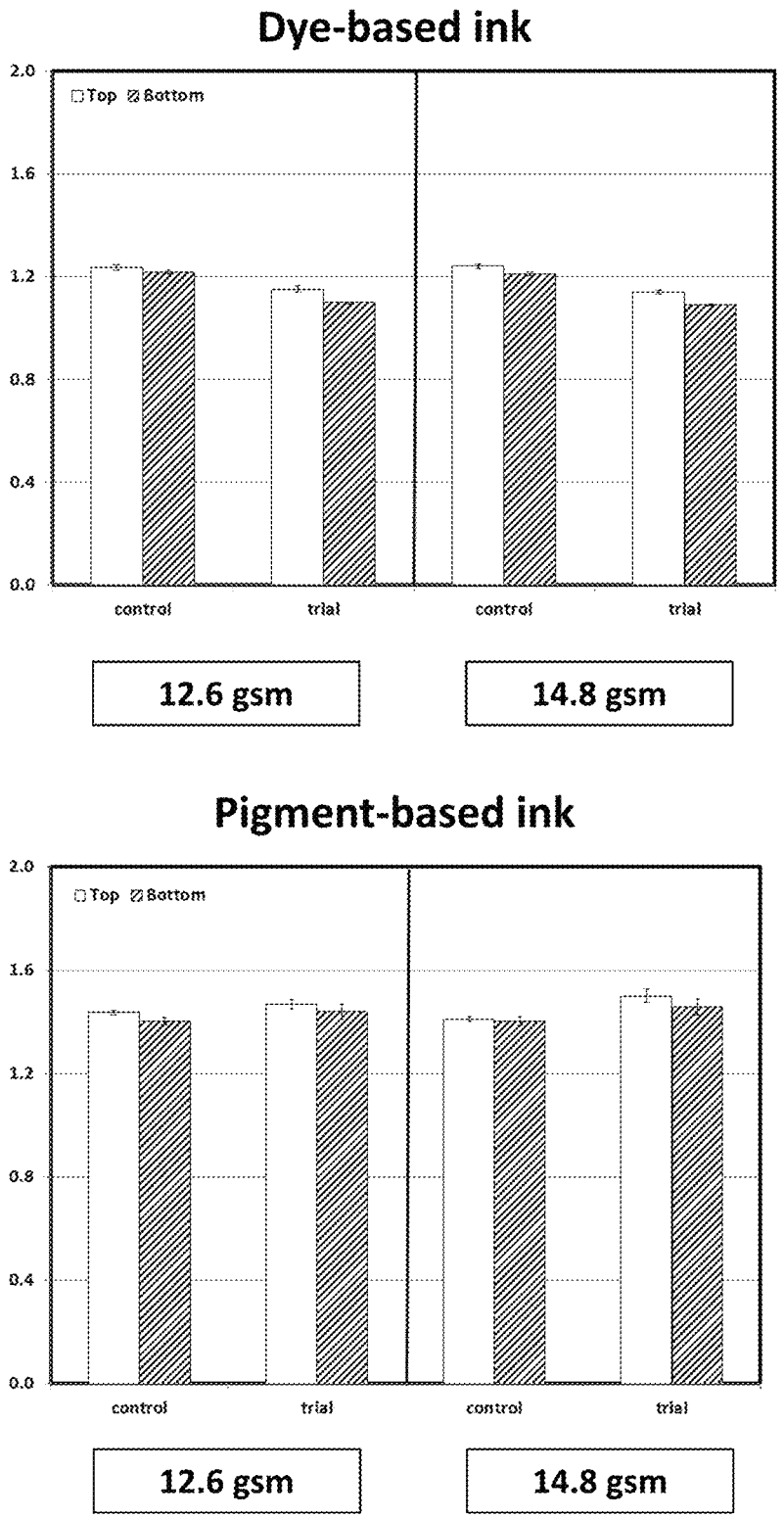
FIGURE 6 - Print density

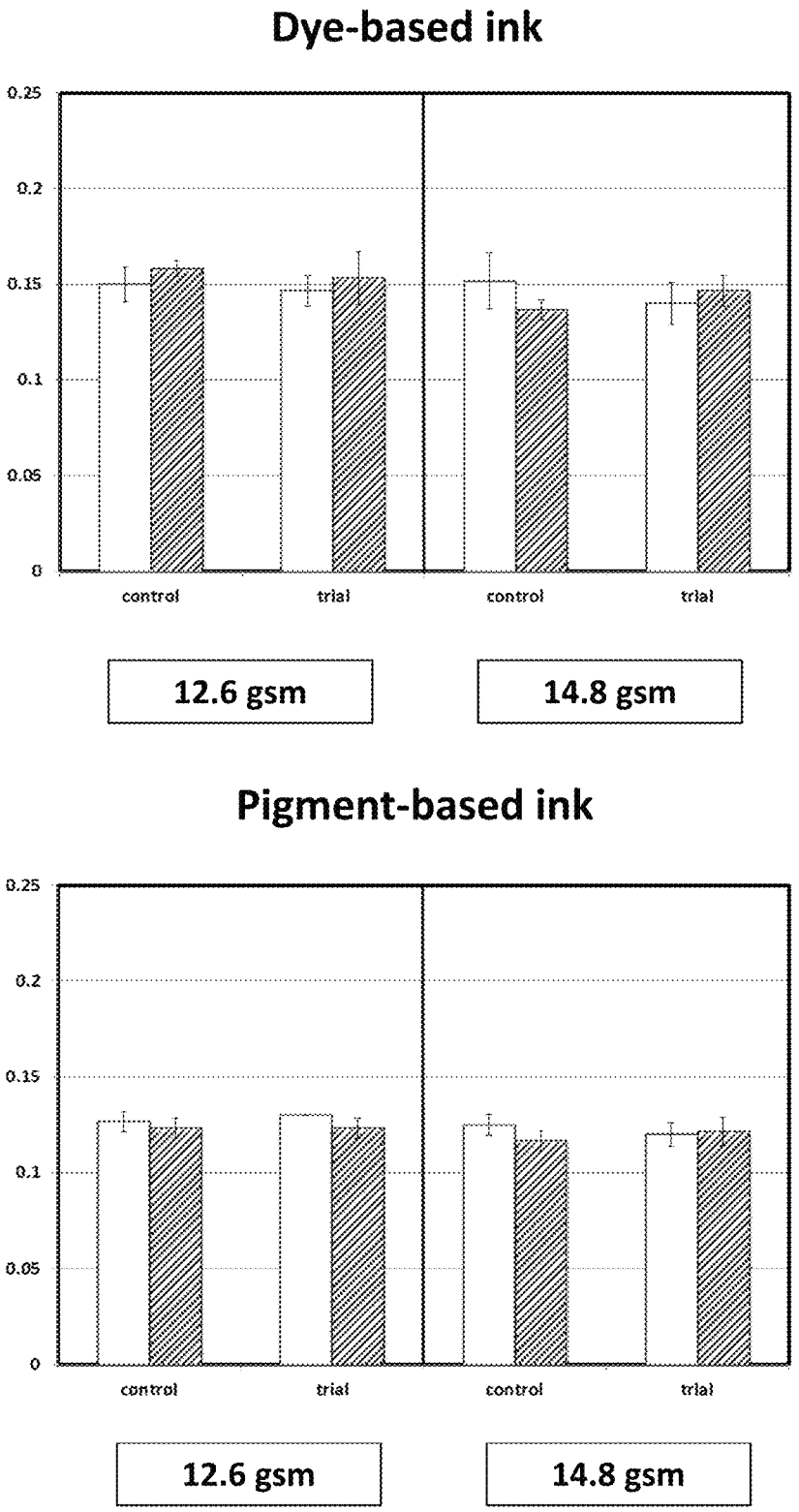
FIGURE 7 - Print through

COATING FOR PAPER ADAPTED FOR INKJET PRINTING

RELATED APPLICATIONS

This application claims the benefit of U.S. provisional application Ser. No. 61/894,528, filed Oct. 23, 2013 and U.S. provisional application Ser. No. 62/053,993, filed Sep. 23, 2014. These applications are incorporated by reference.

FIELD

This specification relates to compositions for paper coatings, inkjet print media and methods of making it, and inkjet printing.

BACKGROUND

High quality paper for inkjet printing may have one or more coating layers intended to improve printing quality. Coated inkjet paper has a coating layer including a substantial amount of pigment and a binder for the pigment. After drying, the coating forms a microporous absorptive layer on the surface of the paper.

The coating layer composition may also be tailored to react with the colorant in the inkjet ink. Water based inkjet inks may have their color provided by either a dye or pigment. A dye is provided in solution while a pigment is provided in dispersion. A paper coating layer can be adapted for use with either or both types of colorant.

Coated paper adapted for printing with inkjet inks having a dye as the colorant are typically formulated with a pigment, a binder for the pigment and a cationic fixative. The binder is typically polyvinyl alcohol (PVOH), which is dissolved in water to make a polymer solution before addition to the coating recipe. The cationic fixative is typically a soluble polyvalent polymer. The cationic fixative reacts with the anionic dye to fix the dye by precipitation. Some examples of coating compositions of this type are described in U.S. Pat. Nos. 6,656,545 and 6,713,550.

Coated paper adapted for printing with inkjet inks having a dispersed pigment as the colorant are typically formulated with a pigment, a binder for the pigment and a salt with a polyvalent metal ion. The salt, typically calcium chloride (CaCl2), provides a metal ion that fixes the pigment by dispersion breakage.

So-called "universal" inkjet paper is adapted for printing with both dye and pigment based inkjet inks and contains both a cationic fixative suitable for fixing a dye and a salt suitable for fixing a pigment.

INTRODUCTION

The following paragraphs are intended to introduce the reader to the detailed description to follow and not to limit or define any claimed invention.

This specification describes compositions useful, for example, in coating a paper substrate intended to be printed with water based inkjet inks having anionic dye colorants. This specification also describes an inkjet print media, such as coated paper, and associated methods. Optionally, the print media may be used in high-speed continuous-feed ink jet printing.

In some examples of a coating formulation or pigmented coating, a cationic binder can function as a binder for the pigment and as a cationic fixative. In one example, the binder is made up of cationic latex forming biopolymer particles, for example cationic starch particles. The cationic binder may be in a blend with or replace other binders such as PVOH. The amount of separate cationic fixative that is required is reduced or a separate cationic fixative may be excluded. Optionally, a salt suitable for fixing an ink pigment may be added. With this addition, the binder is suitable for printing with both dye and pigment type inks.

In some examples of a coating formulation or pigmented coating, the cationic binder is present at 100 parts or less per 100 parts of pigment. Optionally, the cationic binder may be present at from about 2 to 50, or from about 7 to 20, parts per 100 parts of pigment. The binder may have a cationic charge density of at least 0.1 meq per gram of binder, or a cationic charge dose in the coating of at least 1 meq per 100 parts pigment, or a cationic charge dose in a coated layer on the paper of at least 0.1 or 0.2 meq per square meter, preferably not exceeding 2 meq/$m^2$.

A cationic biopolymer particle can function as a cationic fixative even at a low charge density relative to a conventional cationic fixative such as polymerised diallyldimethylammonium chloride (polyDADMAC). Without intending to be limited by theory, the biopolymer particles are primarily latex forming rather than soluble and appear to concentrate their charge close to the surface of the paper. For example, paper or another print media having biopolymer particles providing a charge dose of at least 0.1 or 0.2 meq per square meter for each side coated, preferably less than 2 meq per square meter for each side coated, can be printed with an water based inkjet ink having an anionic dye colorant. In the case of a coating formulation or pigment coating, the cationic charge dose can be 10 meq or less or 5 meq or less per 100 dry parts, or alternatively 15 or 20 meq or less per 100 parts pigment. A charge dose of this magnitude is much less than the charge dose typically provided by a conventional cationic fixative. In some cases, the reduced charge dose can be advantageous because it reduces viscosity or change in viscosity when added to anionic pigments also present in the coating recipe. In some cases, if the cationic biopolymer particles replace a conventional cationic fixative it may also be advantageous that the biopolymer material is bio-based or creates paper that is more easily recyclable.

BRIEF DESCRIPTION OF FIGURES

FIGS. 4 to 7 are graphs showing results of print quality tests using paper coated with an experimental paper coating and a comparative paper coating and printed with water-based inkjet ink.

DETAILED DESCRIPTION

Figure 1:
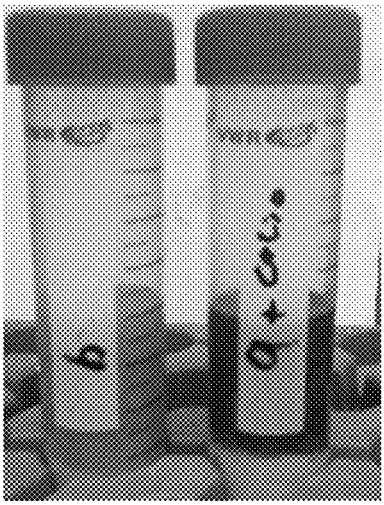
FIG. 1 is a photograph of an experimental paper coating and a comparative paper coating mixed with black water-based, dye-based inkjet ink

In this patent, "coated paper" refers to paper where one or more layers of a coating have been applied to one or both sides to a coat weight of more than 5 grams per meter squared (gsm or g/$m^2$) per layer and the coating is formulated at least with a pigment and a binder for the pigment. A layer typically has a coat weight of about 8 to 15 g/$m^2$. The word "coating color" or "coating formulation" or "coating recipe" interchangeably refers to a coating used to make coated paper. "Pigmented paper" refers to paper that has been coated with at least some pigment and a binder and is applied to a coat weight that does not exceed 5 $g/m^2$ on either side. "Pigmented coating" or "pigment coating" refers to a coating used to make a pigmented paper. Alternative terms used in the paper industry to describe pigmented paper, although not necessarily with exactly the same meaning, include: machine finished, pigmented (MFP) paper; semi-coated printing paper; or, slightly coated paper. In coated paper and pigmented paper, there is usually 100 parts or less of binder per 100 parts pigment, typically 50 parts or less of binder per 100 parts of pigment at least in coated paper. In contrast, "surface-sized paper" refers to paper with a coating that is substantially without pigment (i.e. with essentially no parts pigment per 100 parts binder). The coat weight of surface-sized paper typically does not exceed 5 $g/m^2$ on either side and often around 3 $g/m^2$ on either side. "Surface-sizing" refers to a coating used to make surface-sized paper. Alternative terms used in the paper industry to describe surface-sized paper, although not necessarily with exactly the same meaning, include film-coated paper and surface-treated paper.

Different groups in the paper industry may use the terms above with different meanings. For example, the term "surface treated paper" is sometimes used to refer to paper with a coating that has some pigment, but very little, possibly 25 parts or less pigment per 100 parts binder. In some cases, the dividing line between pigmented and coated paper is higher, for example at a coat weight of about 7 or 8 $g/m^2$. However, the terms will be used in this patent as described above unless indicated otherwise.

"Paper" refers to a substrate containing cellulose fibers. Although paper is the most commonly printed substrate, other media or substrates, for example corrugated board or other packaging, may also be printed with ink in a manner analogous to printing paper. A coating makes the substrate more receptive to printing with ink. Inkjet printing, including high speed inkjet printing, is a non-impact printing method or digital printing technique where picoliter volumes of ink are delivered to the printed areas of an ink receiving media such as paper, for example uncoated, surface sized, pigmented or coated paper, using nozzles "Pigment" refers to a pigment, or a blend of more than one type of pigment, dry or pre-dispersed in water. Examples of pigment include, but are not limited to, inorganic pigments such as calcium carbonate, clay, silica, kaolin, talc, titanium dioxide and zeolites. Pigments may also be organic, such as plastic pigments, but inorganic pigments are preferred.

A coating color or pigmented coating may also have various other non-fixative additives. Possible additives include, but are not limited to, dispersants, optical brightening agents, rheology modifiers or thickeners, lubricating agents and biocides.

Some water-based inkjet inks include a dispersed functional material, typically a pigment (this is an ink pigment and not the same as pigment in the paper coating). To make a paper coating suitable for use with water based inkjet inks having a dispersed pigment as colorant, a salt containing a polyvalent metal ion suitable to fix the pigment on the substrate is added to the coating. The salt is typically a metal salt. Suitable salts include (but are not limited to): aluminum chloride, aluminum hydroxyl chloride, aluminum nitrate, aluminum sulphate, beryllium chloride, beryllium nitrate, calcium acetate, calcium chloride, calcium nitrate, magnesium chloride, magnesium acetate, magnesium nitrate, magnesium sulphate, barium chloride, barium nitrate, zinc chloride, zinc nitrate, hydrated versions of these salts, and mixtures of two or more of these salts. One commonly used salt is calcium chloride.

Some other water-based inkjet inks include a soluble functional material, typically an anionic dye. To make a paper coating suitable for use with water based inkjet inks having anionic dye as colorant, a cationic fixative may be added to the paper coating. The cationic fixative is typically a soluble polymer with a polyvalent cationic functional group. One commonly used cationic fixative is polymerised diallyldimethylammonium chloride (polyDADMAC).

In an alternative coating color or pigmented coating suitable for use with water based inkjet inks having anionic dye as colorant described herein, a cationic binder is used. The cationic binder acts as a binder and also as a cationic fixative. This allows the amount of a separate cationic fixative (such as polyDADMAC) to be reduced or, optionally, the coating might not have a separate cationic fixative. Instead, the coating may consist essentially of a cationic binder and pigment, optionally with various other non-fixative additives as described above.

A cationic binder can be provided, for example, by way of cationic cooked starch or a functionalized conventional synthetic latex binder such as PVOH. A preferred cationic binder is made of a dispersion of cationic biopolymer particles. The biopolymers typically do not exist in nature as particles that, in dispersion, have material binding activity. However, the biopolymers may be regenerated from their naturally occurring form into a latex forming, or at least readily dispersible, particle. Such a re-formed particle may be referred to as a regenerated biopolymer particle. The regenerated cationic biopolymer particles can be used as a binder for pigment in a coating color or pigmented coating, as a cationic fixative, or both.

A preferred process of making regenerated biopolymer particles is by reactive extrusion. A biopolymer such as starch is plasticised using shear forces in an extruder. In a downstream portion of the extruder, the biopolymer molecules are formed into particles of a desired size. In one example, starch and a plasticizer are added to the feed zone of an extruder. The starch is thermo-mechanically processed in a reaction zone of the extruder such that the crystalline structure of the native starch grain is substantially removed. For example, the starch may be processed at temperature of, preferably, at least 150 degrees C. and specific mechanical energy of, preferably, at least 400 J per g or starch. A crosslinking agent is added to the extruder in a less intensely mixed zone of the extruder downstream of where the starch is plasticized. A slurry of regenerated starch particles is produced through a die at the end of the extruder. The resulting particles have an average particle size of less than 2500 nm, preferably less than 1000 nm, more preferably less than 400 nm. The average particle size may be measured either as the volume average of a dynamic light scattering (DLS) measurement of the D50 value of a nanoparticle tracking analysis (NTA) measurement. The particles are typically nanogels. The cationic biopolymer nanoparticles may have other components or additives but they are primarily, for example at least 50% or at least 80%, made up of one or more biopolymers.

Some further examples of regenerated biopolymer particles, and methods of making them, are described in U.S. Pat. No. 6,677,386 (Biopolymer Nanoparticles) which corresponds with International Publication WO 00/69916; US Patent Publication 2013062807 (Process for Producing Biopolymer Nanoparticles); International Publication Number WO 0208516 (Use of Dispersions of Crosslinked Cationic Starch in Papermaking); International Publication Number WO 0208517 (Use of Starch Dispersions as a Binder in Coating Compositions and Process for Preparing the Starch Dispersions); *Starch nanoparticle formation via reactive extrusion and related mechanism study*, Song et. al., Carbohydrate Polymers 85 (2011) 208-214; US Patent Publication 20110042841; International Publication Number WO 2011/071742; International Publication Number WO 2011/155979; U.S. Pat. No. 6,755,915; International Publication Number WO 2010/084088; and, International Publication Number WO 2010/065750. Alternatively, non-regenerated particles may be used provided that the particles are small (for example less than 2500 nm), generally insoluble, and can function as a binder. For example, British patent GB 1420392 describes a method of producing fragmented starch particles. Regenerated particles are preferred, however, because they are likely to have lower viscosity and to be less prone to retrogradation. All of the publications mentioned in this paragraph are incorporated herein by reference.

As discussed in WO 0208516, cationic starch may be used to make the particles. In this case, the resulting particles are also cationic. Cationic starches that can be used to make regenerated particles include tertiary aminoalkyl ethers, quaternary ammonium ethers, aminoethylated starches, cyanamide derivatives, starch anthranilates and cationic dialdehyde starch. Starch functionalized with quaternary ammonium is preferred. Other biopolymers may also be functionalized to be cationic.

In experimental examples described herein, commercially available cationic starch with quaternary ammonium ethers, of the type normally used to produce cooked starch in the wet end of papermaking, was fed to an extruder. The resulting particles have a charge density of about 0.3 meq/g. This charge density was found to be suitable for the exemplary coating formulations described in the examples section below. Alternatively, a greater charge density could be achieved by increasing the degree of substitution of quaternary ammonium ethers or another cationic functional group. An increased charge density could be useful in coatings with light coat weight.

In some of the coating colours of the experimental examples, the cationic particles are provided at between 8 and 14 parts per 100 parts pigment. This produces a charge density of 2.4 to 4.2 meq per 100 parts pigment or about 1.9 to 3.4 meq per 100 dry parts. In the coated paper of the experimental examples described herein, we used 8.5 gsm of coat weight, which provided cationic charge doses of 0.16 to 0.28 meq per square meter of paper. Using these same coating colours at other coat weights could produce cationic charge doses ranging from about 0.1 to 0.7 meq per square meter of paper.

In general, a coating color suitable for making print media adapted for inkjet printing applications using water based, dye-based ink may include a cationic, preferably cross-linked, preferably bio-based (for example starch based), particulate binder. This coating color requires less cationic fixative than what is typically required. The coating color may have less than 100 parts cationic fixative per 100 parts binder, preferably less than 50 parts cationic fixative per 100 parts binder, or optionally does not have any cationic fixative other than the cationic particles of the binder. The cationic particles can be blended with another binder or, optionally, the cationic particles may be the only binder. The cationic particles may have cationic functionality provided by quaternary ammonium. The cationic particles may be mixed with pigment and water, and optionally other non-fixative additives, to make a coating color.

For pigmented papers, a pigment coating containing 50 parts cationic biopolymer particles per 100 parts pigment has a cationic dose of about 15 meq per 100 parts pigment, or 10 meq per 100 dry parts. A 5 gsm coat weight of this formulation would provide 0.5 meq of cationic charge per square meter on the paper. Coat weights between 1 and 7 gsm all produce a charge dose on the paper similar to the charge dose provided by the experimental coating colours described above. Other pigment coating formulations could also be used, but it is preferably to keep the cationic dose at about 20 meq per 100 parts pigment or less to avoid an increase in viscosity when mixing with anionic pigment.

A coating color or pigmented coating having the cationic biopolymer particles, or another cationic binder, may optionally include a dispersed ink pigment fixing metal ion, for example by adding $CaCl_2$ to the composition.

The cationic biopolymer particles can be used as a cationic fixative to make paper suitable for printing with water based inkjet ink containing an anionic dye. The charge dose on the paper can be at least about 0.1 or 0.2 meq per square meter of paper, which is sufficient to fix anionic dye in the ink. The cationic charge dose preferably does not exceed about 1 or 2 meq per square meter of paper particularly when a coating containing pigment, especially anionic pigment, is applied.

A preferred cationic biopolymer particle, for use as a binder or a cationic fixative or both, is a regenerated cationic starch particle. The regenerated cationic starch particle is preferably one or more of: hydrophilic; usable without cooking; water dispersible; results in a polymeric dispersion or latex; a nanogel; and has an average particle size of 1000 nm or less, or 400 nm or less.

The cationic starch particles have a high molecular weight but dispersions of the particles have a viscosity suitable for paper coating. For example, a 25% solids dispersion can have a viscosity between 100 and 500 cps at 20° C. with a Mw of 900 to 1500 kDa. Other molecular weights can also be used. In comparison, one 15% solids PVOH solution used in a coating colour had a viscosity between 100 and 500 cps at 20° C. with a Mw of 10 to 50 kDa. The effect of this difference is a reduced coating viscosity in formulations containing substantial amounts of pigment such as coating colours and pigmented coatings. Alternatively, coating with a regenerated biopolymer particle based binder may be applied at a solids content that is a few percent higher than with a PVOH based binder.

The charge density of regenerated cationic starch particles may be, for example, 1 meq/g or less, or 0.5 meq/g or less to a lower limit of about 0.1 meq/g. One sample has a charge of about 0.3 meq/g as measured by colloidal titration. When such cationic starch particles are used in a coating color or pigmented coating, there may be a charge dose of, for example, 20 meq per 100 parts pigment or less, or 15 meq per 100 parts pigment or less, or 5 meq per 100 parts pigment or less to a lower limit of about 1 or 2 meq per 100 parts pigment. For further example, there may be a charge dose of about 2.4 to 4.2 meq per 100 parts pigment. In comparison, polymerised diallyldimethylammonium chloride (polyDADMAC) for use as a cationic fixative may have a molecular weight of about 1 to 100 kDa. One sample measured had and a charge density of about 6 meq/g. In a typical coating colour formulation, the polyDADMAC would produce a dosage of about 45 meq per 100 parts pigment.

Even at a relatively low charge density, cationic biopolymer particles are effective to fix an anionic dye. Without intending to be limited by theory, the effectiveness of the cationic particles relative to their charge dose may be because the generally insoluble particles preferentially remain on the surface of the paper. In contrast, polyDADMAC is a soluble polymer that can easily migrate to the base paper. Further, cationic biopolymer particles, at a dosage required for equal binding strength, result in paper coatings with water retention values higher than coatings containing a typical PVOH based binder. Accordingly, the cationic charge provided by biopolymer particles preferentially stays on the outer layer of the coating where it is most effective.

A relatively low charge density advantageously minimizes viscosity change in the coating when an anionic pigment (or pigment blend) such as calcium carbonate or kaolin clay is added to a coating composition. In contrast, adding polyDADMAC to a slurry of anionic pigment (or pigment blend) to make a coating color causes a viscosity peak. This complicates coating preparation procedures or restricts choice in pigment blends. For example, polyDADMAC can form a solid with kaolin clay, which makes it unusable with this pigment. In contrast, coatings with cationic starch particles used in a charge dose of about 3.6 meq per 100 parts pigment did not exhibit any material viscosity peak or unacceptable reactions with calcium carbonate or kaolin clay whether anionically or cationically dispersed.

In a coating color or pigmented coating the cationic biopolymer particles may be provided at a dosage ranging from about 2 to 50, or from about 7 to 20 or 8 to 14, parts per 100 parts of pigment. A coating with cationic biopolymer (preferably cationic waxy starch) particles in this dosage range above does not require PVOH (or any other secondary binder) and does not require any cationic fixative. A dispersant, for example at about 1 part per 100 of pigment may be added. Optionally, a metal salt such as $CaCl_2$ at about 10 parts per hundred of pigment may be added. These parts may be mixed into about 40 to 50 parts of water per 100 parts of pigment. Total solids content of the coating may optionally be in the range of 45-60%. Coatings according to the formulations described above have useful print quality with both dye and pigment based inkjet inks. Removing the metal salt provides a coating that has useful print qualities for dye based inkjet inks.

In a light coating colour (e.g. 8 gsm), adding cationic biopolymer particles with a charge density of about 0.3 meq/g at 8 to 14 parts per 100 parts of pigment or more provides a charge on the paper of about 0.2-0.3 meq per square meter of paper or more. In another coating, either a coating colour with a higher coat weight or higher cationic binder dose or using more highly charged cationic biopolymer particles, or a pigmented coating, the charge on the paper is likely to remain below 2, more likely below 1, meq per square meter of paper.

EXAMPLES

Various samples of paper coatings were prepared with 100 parts pigment, 4-14 parts cationic starch latex forming particles, 10 parts calcium chloride and 1 part dispersant. The pigment, unless stated otherwise, was 30 parts modified calcium carbonate (MCC) and 70 parts ground calcium carbonate (GCC). The cationic starch particles and pigment were dispersed in water.

The charge density of the starch particles was about 0.3 meq/g as determined by colloidal titration. The coating has a charge of, for example, 3.6 meq per 100 g of pigment when mixed at 12 parts starch particles per 100 parts pigment. Coatings according to this general formulation will be referred to as Sample A.

Comparative Example

Samples of a comparative paper coating were prepared with 100 parts pigment, 5 parts of a proprietary non-cationic binder, 7.5 parts cationic fixative, 10 parts calcium chloride and 1 part dispersant. The pigment, unless stated otherwise, is 30 parts MCC and 70 parts GCC. The cationic fixative is polyDADMAC.

The cationic fixative has a charge of about 6 meq/g as determined by colloidal titration. The coating has a charge of 45 meq per 100 g of pigment. Coatings according to this formulation will be referred to as Sample B.

Experimental Results

Binding strength: Coatings according to Sample A and Sample B were made up to a solids content of 53% for each sample and were coated on paper at the same coat weight of 8.5 gsm. Sample A formulations with 4 and 6 parts starch did not develop significant dry strength. Sample A formulations with 8 to 14 parts starch developed dry strengths ranging from 12 to 50 vvp as measured by IGT method. Dry strength of Sample B was about 17 vvp. From these results, it was determined that Sample A formulations with 8 or more parts binder would have suitable strength.

Dye fixing: FIG. 1 is a photograph of black ink mixed with Sample A (on the left) and sample B (on the right). Sample A has a lighter color in the supernatant indicating that more of the ink is in the precipitate relative to Sample B.

Zeta potential of sample A was measured at about 10 mV. Zeta potential of Sample B formulations at a binder dose of 8 parts per 100 parts pigment and above had zeta potential between 12 and 16 mV.

These results suggest that Sample A should have less charge migration into the paper than Sample B. More of sample A should remain in the dried paper coating.

Figure 2:
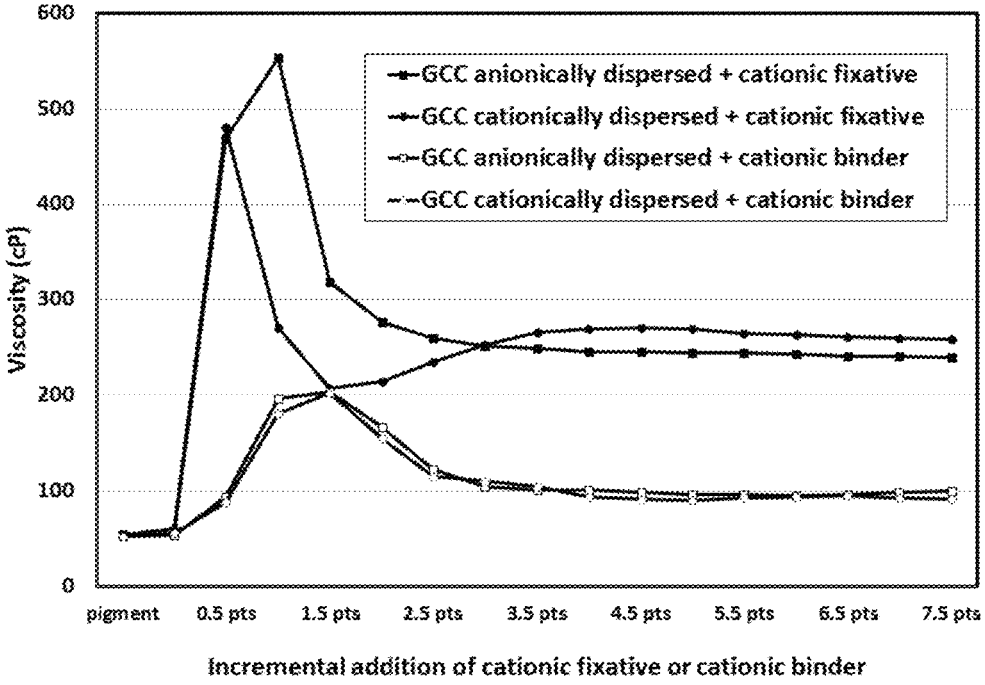
FIG. 2 is a graph of viscosity produced while adding a cationic fixative and cationic starch particle to a dispersion of pigment.

Compatibility with Inorganic Pigment: Ground calcium carbonate (GCC) pigment was dispersed with either an anionic or cationic dispersant. Cationic fixative (polyDADMAC) or the cationic biopolymer particles were incrementally added to each dispersed pigment. Viscosity of the mixture was measured as the cationic fixative or binder was added. As shown in FIG. 2, with the cationic fixative the viscosity went through a peak of about 500 cP before stabilizing at a lower value. With the cationic binder the viscosity remained low throughout the test with no peak in viscosity.

Figure 3:
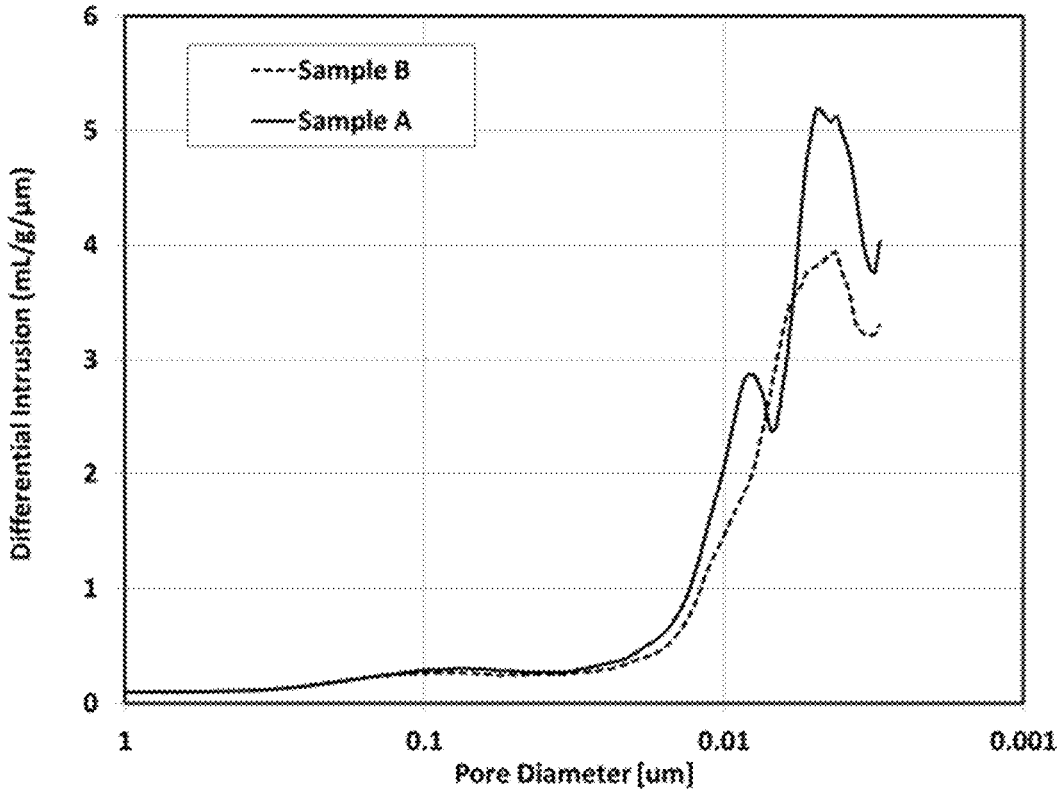
FIG. 3 is a graph of differential intrusion for an experimental paper coating and a comparative paper coating.

Microporosity: Sample A and Sample B were coated at 53% solids. Mercury Intrusion Porosimetry was used to measure differential intrusion. The results are shown in FIG. 3. As indicated therein, Sample A exhibited a higher capillary action, suggesting that more pores remain open in the size range of 10 to 100 nm, than for Sample B.

Static Water Retention of the Coated Paper: Coated paper samples were made by coating paper at a 8.5 gsm coat weight with Sample A mixed at 12 parts starch and Sample B. 81-115 gsm of water left the coating of papers coated with Sample A. 149 gsm of water left the paper coated with Sample B.

Print Quality: Papers were coated with Sample A (12 parts cationic binder) and Sample B in a pilot coater (metering size press, 12.6 or 14.8 gsm, soft-nip calendered) and printed with an HP Photosmart D7360 (dye-based ink) and an HP Officejet Pro 8100 (pigment-based ink). Color management was provided by Acrobat, sRGB IEC 61966-2.1, preserve black and CMYK primaries. A test pattern included skin tones and had a resolution of 600 dpi. Test pattern for feathering was a black line on yellow background (vertical and horizontal). Test pattern for mottle had green solid areas. Test pattern for print density was a black solid area. The backside of the black solid area was used to measure print-through.

FIGS. 4 to 7 show the results of measurements of feathering; mottle; black print density; and, print through. In each Figure, Sample B is labeled as the control and Sample A is labeled as the trial. Referring to FIG. 4 (feathering), a lower value in the Y-axis is preferred. Results were similar as between Sample A and Sample B. Referring to FIG. 5 (mottle solid green area), a lower value in the Y-axis is preferred. Results indicate that Sample A has less mottle with dye-based ink, similar mottle with pigment-based ink. Referring to FIG. 6 (print density), a higher value in the Y-axis is preferred. Results were similar as between Sample A and Sample B. Referring to FIG. 7 (print through), a lower value in the Y-axis is preferred. Results were similar as between Sample A and Sample B. Overall, the results indicate commercially acceptable print quality from Sample A despite its lack of a separate cationic fixative and relatively low charge dose.

We claim:

1. A composition comprising, pigment; and, a cationic binder comprising cationic regenerated biopolymer particles, wherein the cationic regenerated biopolymer particles and the pigment are present in amounts sufficient to provide a charge density of less than about 20 meq per 100 g of pigment.

2. The composition of claim 1 wherein the binder is present at 100 parts or less per 100 parts of pigment.

3. The composition of claim 1 wherein the binder has a cationic charge density between about 0.1 and 1.0 meq per gram of binder.

4. The composition of claim 1 wherein the binder is water-dispersible.

5. The composition of claim 1 wherein the cationic regenerated biopolymer particles comprise hydroxyl groups functionalized with quaternary ammonium.

6. The composition of claim 1 wherein the binder is provided at from about 2 to 50 parts per 100 parts of pigment.

7. The composition of claim 1 consisting essentially of pigment and cationic binder.

8. The composition of claim 1 substantially without a separate cationic fixative.

9. The composition of claim 1 wherein the cationic regenerated biopolymer particles are latex forming cationic starch particles.

10. The composition of claim 9 wherein the particles are regenerated starch particles.

11. The composition of claim 9 wherein the starch particles are made by extruding starch.

12. The composition of claim 9 wherein the starch particles are internally crosslinked.

13. A paper coated with the composition of claim 1.

14. The paper of claim 13 printed with ink comprising an anionic dye.

15. The paper of claim 13 with a coat weight of 0.5 grams per square meter or greater.

16. The paper of claim 15 with a coat weight of less than about 20 grams per square meter.

* * * * *